United States Patent [19]

LaBudde et al.

[11] Patent Number: 4,709,972

[45] Date of Patent: Dec. 1, 1987

[54] KEYBOARD CABINET WITH SLIDING TRAY

[75] Inventors: Brian R. LaBudde, Greece; Kevin C. Koek, Rochester, both of N.Y.

[73] Assignee: Eastman Kodak Company, Rochester, N.Y.

[21] Appl. No.: 900,929

[22] Filed: Aug. 27, 1986

[51] Int. Cl.[4] ..... A47B 21/03

[52] U.S. Cl. ..... 312/208; 312/302; 312/323; 361/391; 400/715

[58] Field of Search ..... 312/282, 208, 302, 315, 312/311, 328, 323; 400/715; 361/391

[56] References Cited

U.S. PATENT DOCUMENTS

| | | | |
|---|---|---|---|
| 266,672 | 10/1882 | Landin . | |
| 283,323 | 5/1884 | Cervero . | |
| 4,068,908 | 1/1978 | Horn . | |
| 4,287,764 | 9/1981 | Staab et al. | 361/391 X |
| 4,449,762 | 5/1984 | Turner . | |
| 4,482,064 | 11/1984 | Berke et al. | 400/715 X |
| 4,496,200 | 1/1985 | Hagstrom et al. | 312/282 X |
| 4,511,111 | 4/1985 | Godfrey et al. . | |
| 4,546,947 | 10/1985 | Gesten . | |
| 4,570,156 | 2/1986 | Nicholas, Jr. . | |
| 4,600,247 | 7/1986 | Einhaus . | |
| 4,600,249 | 7/1986 | Anderson . | |
| 4,621,781 | 11/1986 | Springer | 400/715 X |

FOREIGN PATENT DOCUMENTS

| | | | |
|---|---|---|---|
| 627648 | 4/1936 | Fed. Rep. of Germany | 312/208 |
| 1913287 | 9/1970 | Fed. Rep. of Germany | 400/715 |
| 8403573 | 9/1984 | PCT Int'l Appl. | 312/208 |
| 8601086 | 2/1986 | PCT Int'l Appl. | 312/208 |

OTHER PUBLICATIONS

Global Computer Supplies Catalog, 6/1986, p. 14, "The PC Guardian".

*Primary Examiner*—Peter A. Aschenbrenner
*Assistant Examiner*—Thomas A. Rendos
*Attorney, Agent, or Firm*—Norman Rushefsky

[57] ABSTRACT

A cabinet for storing a computer keyboard includes a slidable tray with dust cover door. When the tray is slid to its open position providing access to the keyboard the dust cover door may be pivoted to an orientation wherein the inside of the door is positioned to support the wrists or hands of the operator.

10 Claims, 4 Drawing Figures

KEYBOARD CABINET WITH SLIDING TRAY

BACKGROUND OF THE INVENTION

1. Field of the Invention

The invention relates to cabinets for storing computer keyboards or the like.

2. Description of the Prior Art

The use of computer keyboards in association with various machines such as copiers and printers is well known. It is also well known to have associated with the keyboard a cathode ray tube (CRT) for viewing data input by the operator. As the keyboards are not always needed, it is known to store them within cabinets upon which the CRT may rest. A sliding tray within the cabinet allows the keyboard to be uncovered from the cabinet so that the operator may walk up to the machine and input instructions to the machine via the keyboard. When the keyboard is not in use, the tray is pushed back into the cabinet and thus does not provide an obstacle to persons walking past the machine. It is also known to provide a raised step adjacent the front of the tray. An operator can support his/her wrists or the heels of his/her hands on this step while operating the keyboard. However, the keyboard trays of this type noted in the prior art lack a cover door to reduce the dust that otherwise tends to collect upon the keyboard.

It is therefore an object of the invention to provide an improved cabinet for a computer keyboard that includes a cover door and provides support for an operator's wrists or hands.

SUMMARY OF THE INVENTION

A cabinet includes a housing and a slidable tray supporting a keyboard. The tray has attached thereto a housing cover door that is pivotably mounted to the tray. A rear face of the door is pivotable to a generally horizontal position when the tray is extended from the housing for supporting the wrists or hands of an operator of the keyboard.

DETAILED DESCRIPTION OF THE PREFERRED EMBODIMENT

The preferred embodiment of the present invention will now be described with reference to the accompanying drawings wherein.

Figure 1:
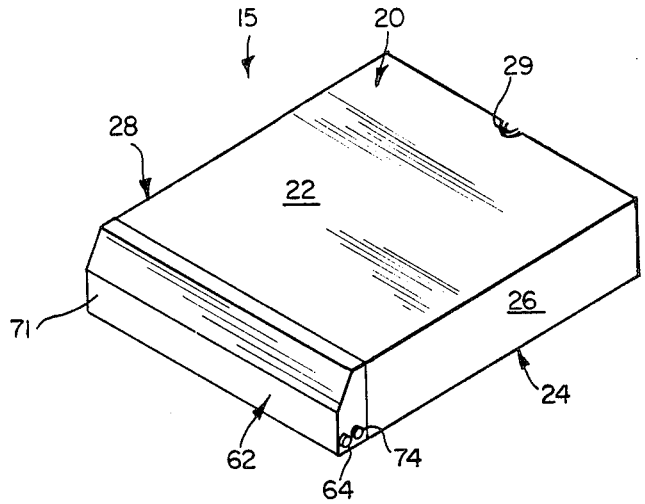
FIG. 1 is a perspective view of a cabinet for storing a keyboard, the cabinet being shown closed.
Figure 2:
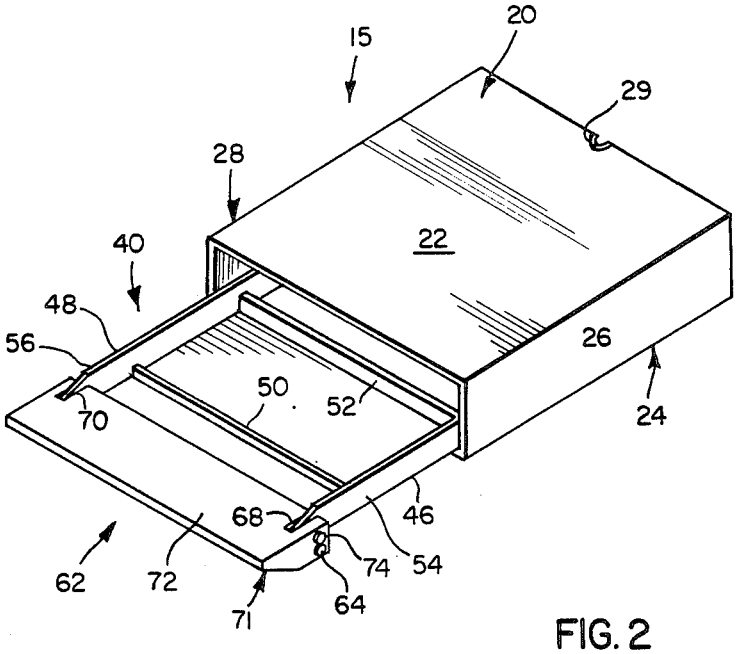
FIG. 2 is a perspective view of the cabinet showing a tray located therein in an extended position.

With reference to FIGS. 1–4, a CRT 10 is shown in phantom resting upon a cabinet housing 20 which in turn rests upon a machine 12 that receives at least some instructions from inputs provided upon a keyboard 14 (also shown in phantom) located within the cabinet 15. The machine may be an electrophotographic copier or printer and a portion of the top surface thereof is also shown in phantom. The cabinet housing is of sheet metal and comprises rectangular top and bottom walls 22, 24 and rectangular side walls 26, 28. Provision is made in the opening 29 at the top rear of the cabinet for providing egress of electrical cables (not shown) to connect to the CRT and the machine that is being instructed. The rear of the cabinet housing may be placed flush against a vertical surface (not shown) of the machine to seal off the rear of the housing.

Secured to the external bottom wall 24 are four rubber buttons or pads 32 for frictionally holding the drawer housing in place against sliding movement relative to the machine. Ribs (not shown) are secured on the inside face of top wall 22 to provide rigidity for supporting the CRT. The ribs extend between the two side walls 26, 28.

Figure 3:
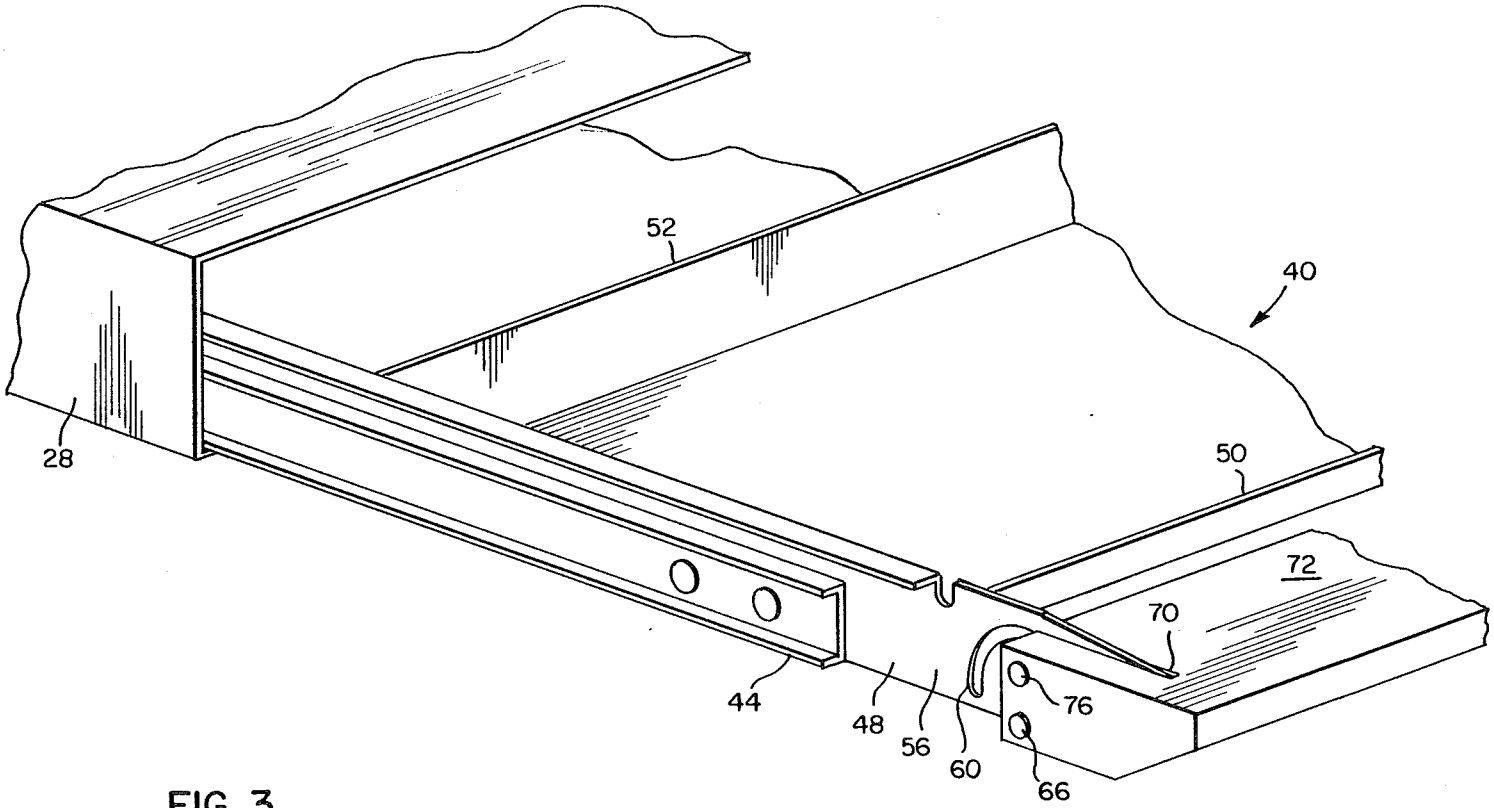
FIG. 3 is a perspective view of the cabinet showing details of portions of the tray and a dust cover door.
Figure 4:
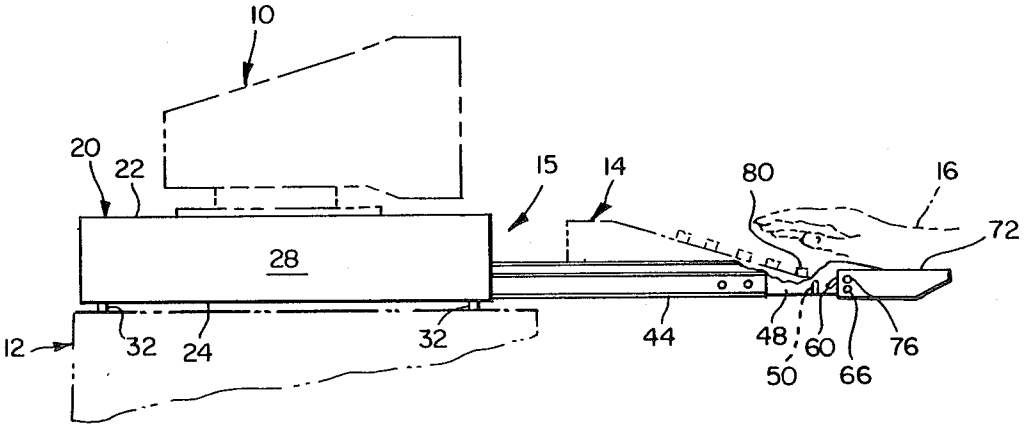
FIG. 4 is a side elevational view of the cabinet with tray extended showing in phantom a CRT, a top of a copier or printer, a keyboard and a hand of a keyboard operator.

A tray 40 is slidably supported within the housing 20 by conventional means which may take the form of elongated channels (not shown) located on both inside faces of the side walls 26, 28 which cooperate with channels (only one of which 44 is shown) secured to upturned side rim walls 46, 48, respectively of the tray. Ball bearings are provided within the slide movement to provide for a smooth sliding between tray and cabinet housing. A suitable sliding mechanism of this type is commercially available and is sold under the trademark ACCURIDE. ACCURIDE is a registered trademark of Standard Precision, Inc. The tray also includes front and rear rim walls 50, 52 between which the keyboard may be positioned. Tabs 54, 56 extend forwardly from side rim walls 46, 48 and are each provided with an arcuate guide slot, one of which 60 is shown in FIG. 3. The slots are each approximately one-quarter segments of a circle.

A dust cover door 62 is pivotally secured to the side rim walls at the tabs by pins or rivets 64, 66. The door may be formed of fiber board or other suitable materials and includes a front face or wall 71 and a rear face or wall 72. The tabs extend into narrow slots 68, 70 formed in the rear wall 72 of the dust cover door. Pins 74, 76 are also located within the door and extend through respective arcuate guide slots. Pins 74, 76 cooperate with the slots to serve as a stop and support the door so that when the door is in is open position the generally flat rear wall 72 is supported approximately horizontally. With a keyboard 14 positioned within the cabinet it has been found that a preferred placement location of the door's rear wall 72 is approximately level with the top surface of the spacer bar 80 on the keyboard 14. The keyboard contains a series of alpha-numeric characters and other keys in various rows or steps placed at different horizontal levels. The spacer bar is on most standard keyboards an elongated bar that is located on the lowermost of these steps. The spacer bar will be located about 0.5 inches (1.27 cm) from the front rim wall 50 and the top surface of the spacer bar key will be about 1 inch (2.54 cm) from the bottom of the tray. When keying or operating the keyboard to provide instructions to the machine 12, the heels of the hands or wrists 16 of the operator (shown in phantom) are supported by the rear wall of the cover door and provide a comfortable means for operating the keyboard.

When the operator is through keying in instructions to the machine, the door may be pivoted 90° to its closed position and the tray moved rearwardly back into the cabinet housing 20 after first releasing conventional detents (not shown) provided along the channel slides. With the tray located within the cabinet housing, the rear face of the door covers the front of the housing to minimize dust collection on the keyboard.

If desired, means may be provided to prevent tipping over of the cabinet while the tray is extended outwardly due to the downward force upon the door in supporting the operator's hands or wrists. One means may comprise providing a VELCRO (trademark) band across the bottom wall of the cabinet at the rear thereto and a complementary securing VELCRO band secured to the machine surface to counter the force on the door. VELCRO bands are a fastener that employ on one fastening surface a series of hair-like hooks and employ on a second fastening surface hair-like loops to which the hooks become detachably engaged.

The invention has been described in detail with particular reference to preferred embodiments thereof. However, it will be understood that variations and modifications may be effected within the spirit and scope of the invention.

We claim:

1. A work station cabinet for keying entries into a keyboard, the work station cabinet comprising:

a housing having an opening in a front face thereof;

a tray means having a surface for supporting the keyboard;

means coupling the tray means and the housing for movement of the tray means through the front face of the housing to an extended position wherein the keyboard is outside the housing and accessible for keying of entries thereinto, and to a retracted position wherein the keyboard is located within the housing for storage;

a door pivotably connected to the tray means, the door having a front face and a rear face, the rear face cooperating with the housing to seal the front face of the housing when the tray means is in its retracted position when the door is pivoted to a generally vertical orientation; and means for supporting the door so that the rear face is in a generally horizontal orientation while the tray means is in its extended position, the rear face of the door being elevated relative to said surface of the tray means, without overlying the surface of the tray means, and providing support for the hands or wrists of an operator for keying entries into the keyboard.

2. The work station cabinet of claim 1 and including a keyboard and further including a forward rim means on the tray means for locating a forward surface of the keyboard, the keyboard resting on the tray means and including a series of rows of keys progressively rising as the keyboard extends towards the rear of the tray means and wherein the rear face of the door when oriented generally horizontally is substantially level with the tops of the bottom row of keys on the keyboard.

3. The work station cabinet of claim 1 and wherein the tray means includes a forward rim wall for locating a forward surface of a keyboard and wherein the rear face of the door, when in the generally horizontal orientation is spaced from the rim means for supporting the hands or wrists of an operator for keying entries into the keyboard.

4. The work station cabinet of claim 1 and wherein a keyboard is supported on the tray means.

5. A work station cabinet for keying entries into a keyboard, the work station cabinet comprising:

a housing having an opening in a front face thereof;

a tray means having a surface for supporting the keyboard;

means coupling the tray means and the housing for movement of the tray means through the front face of the housing to an extended position wherein the tray means is outside the housing allowing an operator access to the keyboard for keying entries thereinto, and to a retracted position wherein the tray means is located within the housing for storage of the keyboard;

closing means movably connected to the tray means, the closing means having a surface, the closing means cooperating with the housing to close the opening in the front face of the housing when the tray means is in its retracted position and the closing means is moved to a generally vertical orientation with the surface of the closing means facing into the housing; and means for movably connecting the tray means to the closing means and for supporting the closing means so that the surface of the closing means is in a generally horizontal orientation while the tray means is in its extended position, the surface of the closing means being supported elevated relative to said surface of the tray means, without overlying the surface of the tray means, so as to provide support for the hands or wrists of the operator for keying entries into the keyboard.

6. The work station cabinet of claim 5 and including a keyboard, the keyboard resting on the tray means and including a series of rows of keys progressively rising as the keyboard extends towards the rear of the tray and wherein the surface of the closing means when oriented generally horizontally is substantially level with the tops of the bottom row of keys on the keyboard.

7. The work station cabinet of claim 5 and wherein the surface of the closing means seals the front face of the housing.

8. The work station cabinet of claim 5 and wherein the surface of the closing means includes two narrow slots formed therein, the tray means includes two opposed side rim walls at the sides of the tray, a tab extends from each of the side rim walls into a respective one of said slots formed in the closing means; an arcuate slot is provided in each tab, a pin means is located within the closing means and extends through and cooperates with one of said arcuate slots for supporting the closing means in its generally horizontal orientation, and a second pin means pivotably connects the tray means to the closing means.

9. The work station cabinet of claim 5 and wherein a keyboard is supported on the tray means.

10. The work station cabinet of claim 5 and wherein the tray means includes a forward rim wall for locating a forward surface of a keyboard and wherein the surface of the closing means, when in the generally horizontal orientation, is spaced from the rim means for supporting the hands or wrists of an operator for keying entries into the keyboard.

* * * * *